United States Patent [19]

Takata

[11] 4,401,713

[45] Aug. 30, 1983

[54] POLYESTER FIBER COMPOSITE MATERIAL USEFUL FOR REINFORCING RUBBER ARTICLES AND PROCESS FOR PRODUCING THE SAME

[75] Inventor: Tadahiko Takata, Ibaraki, Japan

[73] Assignee: Teijin Limited, Osaka, Japan

[21] Appl. No.: 300,754

[22] Filed: Sep. 10, 1981

[30] Foreign Application Priority Data

Sep. 16, 1980 [JP] Japan ..... 55-127104
Sep. 16, 1980 [JP] Japan ..... 55-127105

[51] Int. Cl.[3] ..... B05D 3/02; B32B 27/00; D02G 3/00

[52] U.S. Cl. ..... 428/290; 260/739; 427/381; 427/386; 427/389.9; 428/375; 428/378; 428/380; 428/383; 428/395; 523/402; 525/109; 525/111

[58] Field of Search ..... 427/381, 386, 389.9, 427/412.5; 428/375, 378, 380, 383, 395, 290; 260/739; 523/402; 525/109, 111

[56] References Cited

U.S. PATENT DOCUMENTS 3,231,412 1/1966 Pruitt et al. ..... 427/381 X
3,775,150 11/1973 McClary ..... 427/381 X
4,248,938 2/1981 Takata et al. ..... 428/414

FOREIGN PATENT DOCUMENTS 2009806 6/1979 United Kingdom ..... 427/381

*Primary Examiner*—Michael R. Lusignan
*Attorney, Agent, or Firm*—Burgess, Ryan & Wayne

[57] ABSTRACT

A polyester fiber composite material useful for reinforcing rubber articles, comprises a polyester fiber substrate impregnated with an impregnating composition containing (A) a polyepoxide compound, (B) a rubber latex, (C) a resorcin-formaldehyde prepolymer and a water-soluble polyurethane compound of the formula (I):

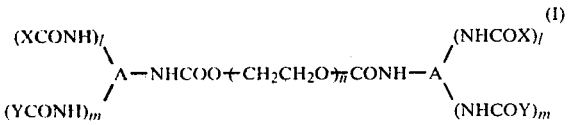

(I)

wherein A = a tri-hepta valent radical, X = a monovalent residue of blocking compound capable of dissociating from the compound (c) at an elevated temperature, Y = a monovalent residue of an aminosulfonic acid having 2 to 6 carbon atoms or aminocarboxylic acid having 1 to 6 carbon atoms, n = 5–30, m = 1–5, l = 1–5 and l + m = 2–6, the impregnating composition having been heat-treated on the substrate at least once at a temperature of 120° C. to the melting point of the polyester fiber.

43 Claims, No Drawings

POLYESTER FIBER COMPOSITE MATERIAL USEFUL FOR REINFORCING RUBBER ARTICLES AND PROCESS FOR PRODUCING THE SAME

FIELD OF THE INVENTION

The present invention relates to a polyester fiber composite material useful for reinforcing rubber articles and a process for producing the same. More particularly, the present invention relates to a polyester fiber composite material which exhibits an excellent bonding property to rubber, an excellent rubber coverage, a proper softness or stiffness and a superior resistance to fatigue fracture and, therefore, is useful for reinforcing rubber articles, and a process for producing the same.

BACKGROUND OF THE INVENTION

It is known that polyester fiber materials such as polyester fiber fabrics, polyester fiber cords and polyester fiber threads, have an excellent tensile strength and dimensional stability, and therefore, are useful as a reinforcing material for car tires, conveyor belts, V-belts and hoses. However, since the polyester fiber materials inherently have a poor bonding property to rubber, in order to utilize the polyester fiber material as a reinforcing material for rubber articles, it is required to significantly improve the bonding property of the polyester fiber material to rubber. For this reason, a number of approaches have been taken in attempts to improve the bonding property of the polyester fiber material to rubber. However, during the approaches, it was found that the improvement in the bonding property of the polyester fiber material to rubber causes the resultant improved polyester fiber material to have an excessively high stiffness, a poor processability in the shaping or molding process and a poor resistance to fatigue fracture. For example, U.S. Pat. No. 3,307,966 discloses a process for improving the bonding property of the polyester fiber material to rubber, by first impregnating the polyester fiber material with a first treating liquid containing a polyepoxide compound and an aromatic polyisocyanate compound, and then, by second impregnating the first impregnated polyester fiber material with a second treating liquid containing a reaction product of resorcin with formaldehyde and a rubber latex. The resultant product of the above-mentioned process exhibits a relatively superior bonding property to rubber. However, this known process causes the resultant product to have a relatively high stiffness and, therefore, it is difficult to bend the product during the shaping operation, and the product has a remarkably decreased resistance to fatigue fracture.

Japanese Patent Application Publication (Kokoku) No. 429004 discloses a process in which a polyester fiber material is treated with a first treating liquid containing an epoxy resin, a ethyleneimine compound and a rubber latex and, thereafter, the thus treated polyester fiber material is further treated with a second treating liquid containing a reaction product of resorcin with formaldehyde and a rubber latex. Also, U.S. Pat. No. 3,460,973 discloses a process in which a polyester fiber material is treated with a first treating liquid containing a lactam-blocked polyisocyanate compound, an emulsifying agent and a rubber latex, and then, with a second treating liquid containing a reaction product of resorcin with formaldehyde and a rubber latex. Furthermore, British Pat. No. 1,056,798 discloses a process in which a polyester fiber material is treated with a single treating liquid containing a blocked isocyanate compound, an epoxy resin and a rubber latex without using an additional treating liquid containing a resorcin-formaldehyde resin and a rubber latex. The above-mentioned three processes cause the resultant products to have a proper softness. However, these resultant products have a relatively low bonding property to rubber and, therefore, a poor rubber coverage. The term "rubber coverage" used herein refers to a percentage of total area of portions of the reinforcing material covered with rubber when the reinforcing material is peeled off from the rubber article in which the reinforcing material is embedded within a rubber matrix.

As is clear from the above description, the conventional processes all failed to satisfy all of the requirements of proper softness, high bonding property to rubber and high resistance to fatigue fracture of the rubber reinforcing polyester fiber materials.

Also, it is known that generally isocyanate compounds are easily decomposed when water comes into contact with the isocyanate compounds. Therefore, when isocyanate compounds are used, it is necessary to protect them from water. That is, in order to prepare a treating liquid containing isocyanate compounds, it is necessary to use an organic solvent free from water. This organic solvent must be recovered from the treating process in order to avoid environmental pollution. This necessity causes the treating process to be costly and the working environment for the treating process to be polluted.

Accordingly, in order to avoid the above-mentioned problem, various types of blocked isocyanate compounds which are stable in water, were used for treating the polyester fiber material.

Usually, conventional blocked isocyanate compounds have a high degree of crystallizing property. Therefore, the stability of aqueous dispersions of the blocked isocyanate compounds are poor, to an extent that it is necessary to continuously agitate the aqueous dispersion so as to keep the particles of the blocked isocyanate uniformly dispersed in water. Also, when the aqueous dispersion is used, it is difficult to apply the blocked isocyanate particles uniformly on the polyester fiber material. In order to obtain a satisfactorily uniform bonding property, it is necessary to apply a large amount of the aqueous dispersion of the blocked isocyanate to the polyester fiber material. Even if a large amount of the blocked isocyanate is used, the resultant product exhibits an unsatisfactory bonding property to rubber and rubber coverage.

Japanese Patent Application Publication (Kokoku) No. 47-49768(1972) and Japanese Patent Application Laid-open No. 54-112295(1979) disclose a process in which a polyester fiber material is impregnated with an impregnating liquid containing an epoxide compound in the presence or in the absence of an epoxy-hardening agent, the impregnated product is heat-treated at a temperature of 150° to 260° C., the heat-treated product is further impregnated with an impregnating liquid containing an ethylene urea compound, a blocked isocyanate compound, a resorcin-formaldehyde reaction product and a rubber latex, and finally, the further impregnated product is heat treated at a temperature of 150° to 260° C. However, in the above-mentioned process, it is difficult to prepare a stable impregnating liquid containing dispersions of the blocked isocyanate compound and the ethylene urea compound having a high degree of crystallizing property and a high degree of hydrophobic property. When the impregnating liquid is stored or allowed to stand, the stability of the impregnating liquid deteriorates with the lapse of time. Also, the ethylene urea compound is in the form of coarse particles having a relatively large size and, therefore, exhibits a poor contribution in the enhancement of the bonding property and the rubber coverage.

In recent years, the form of a V-belt has changed from a conventional wrapped V-belt in which cotton cord fabric is used, to a new raw edge type V-belt in which the polyester fiber material is used as a reinforcing material. In this type of V-belt, the polyester fiber reinforcing material is arranged in the side surface portions of the V-belt so as to expose it to the outside of the V-belt. That is, when the V-belt is used, the side surface of the belt made by the polyester fiber reinforcing material comes into direct contact with a pulley. This direct contact causes the exposed polyester fiber reinforcing material to be abraded and the durability of the V-belt to be degraded. Therefore, in a raw edge V-belt, it is necessary that the polyester fiber reinforcing material exhibits an enhanced resistance to abrasion and that the polyester fiber yarns in the reinforcing material are highly resistive to separation from the rubber matrix. Also, it is necessary that the rubber matrix in the raw edge V-belt has a high degree of resistance to abrasion. In order to attain the above-mentioned property, the polyester fiber reinforcing material must be firmly fixed to the rubber matrix and must exhibit a proper stiffness which is effective for enhancing the resistance of the V-belt to abrasion.

For the above-mentioned purpose, it was attempted to produce a polyester fiber reinforcing material by impregnating a polyester fiber substrate with a first impregnating solution of a polisocyanate compound in an organic solvent, for example, trichloroethylene, perchloroethylene or toluene, and, then, by further impregnating the impregnated substrate with a second impregnating liquid containing a resorcin-formaldehyde reaction product and a rubber latex. In this process, since the polyester fibers are swollen by the organic solvent, the impregnating material can penetrate into the inside of the polyester fibers and of the polyester fiber material. Therefore, resultant polyester fiber reinforcing material can exhibit a significantly enhanced bonding property to rubber and the resultant V-belt exhibits a satisfactory resistance to abrasion. However, the use of an organic solvent results in the above-mentioned disadvantages.

SUMMARY OF THE INVENTION

The object of the present invention is to provide a polyester fiber composite material useful for reinforcing rubber articles, which composite material exhibits an excellent bonding property to rubber, an excellent rubber coverage, a proper softness or stiffness, a superior resistance to fatigue fracture and an enhanced resistance to abrasion, and a process for producing the same without using an organic solvent.

The above-mentioned object can be attained by the polyester fiber composite material of the present invention and the process of the present invention for producing the same.

The polyester fiber composite material of the present invention comprises a substrate comprising a polyester fiber material and impregnated with a polymeric impregnating material which comprises at least the four components of:

(A) at least one polyepoxide compound,
(B) at least one rubber latex,
(C) at least one prepolymer of resorcin with formaldehyde, and
(D) at least one water-soluble polyurethane compound, each of which components has been heat treated on said substrate at least once at a temperature of 120° C. or more, but not exceeding the melting point of the polyester fiber material, which composite material is characterized in that the water-soluble polyurethane compound (D) is of the formula (I):

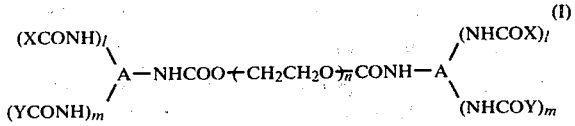

wherein A represents a tri- to hepta-valent radical; X represents a monovalent residue of a blocking compound having an activated hydrogen atom, which residue is capable of dissociating from the polyurethane compound when said heat-treatment is applied thereto; Y represents a monovalent residue of an anionic radical-containing compound selected from the group consisting of aminosulfonic acids having 2 to 6 carbon atoms and aminocarboxylic acids having 1 to 6 carbon atoms; n represents an integer of 5 to 30, and; l and m represent an integer of 1 to 5, respectively and the sum of l and m is an integer of 2 to 6.

The process of the present invention for producing a polyester fiber composite material useful for reinforcing rubber articles, comprises impregnating a substrate comprising a polyester fiber material with a polymeric impregnating material which comprises at least the four components of:

(A) at least one polyepoxide compound;
(B) at least one rubber latex;
(C) at least one prepolymer of resorcin with formaldehyde, and;
(D) at least one water-soluble polyurethane compound, each of which components has been heat-treated on said substrate at least once at a temperature of 120° C. or more, but not exceeding the melting point of the polyester fiber material, (1) by impregnating the substrate one or more times with, in each impregnating procedure, an impregnating liquid containing at least one component of the above-mentioned four components, and;

(2) by applying, after each impregnating procedure, a drying procedure and a heat-treatment to the impregnated substrate at a temperature of 120° C. or more, but not exceeding the melting point of the polyester fiber mateiral, which process is characterized in that the water soluble polyurethane compound (D) is of the formula (I):

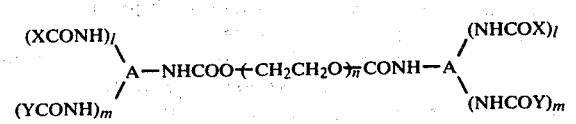

wherein A represents a tri- to -hepta valent radical; X represents a monovalent residue of a blocking compound having an activated hydrogen atom, which residue is capable of dissociating from the polyurethane compound when said heat-treatment is applied thereto; Y represents a monovalent residue of an anionic group-forming compound selected from the group consisting of aminosulfonic acids having 2 to 6 carbon atoms and aminocarboxylic acids having 1 to 6 carbon atoms; n represents an integer of 5 to 30, and; l and m represent an integer of 1 to 5, respectively, and the sum of l and m is an integer of 2 to 6.

DETAILED DESCRIPTION OF THE INVENTION

The polyester fiber composite material of the present invention comprises a substrate comprising a polyester fiber material and a polymeric impregnating material impregnated in the substrate and heat-treated on the substrate at least once.

The polyester fiber material usable for the present invention may consist of a fiber-forming linear polyester, which has been prepared by the reaction of at least one diol compound, for example, ethylene glycol and propylene glycol with at least one dicarboxylic acid selected from aromatic and aliphatic dicarboxylic acids, for example, terephthatic acid, isophthalic acid, naphthalene 2,6-dicarboxylic acid and adipic acid, and their functional derivatives. The linear polyester may be polyethylene terephthalate or polyethylene naphthalate. The polyester fiber material may be in the form of a fabric, a cord or a thread made of the polyester fibers or filaments. The form of the polyester fiber material varies in accordance with the intended use thereof. However, the form of the polyester fiber material may be changed during the process of the present invention. For example, in the process of the present invention, it is possible to apply the first impregnating procedure to polyester fiber threads, and after the drying and heat-treating procedure is finished, the threads are converted into a cord or fabric, and, thereafter, the second impregnating operation is applied to the cord or fabric. Otherwise, it is possible for the threads to be converted into a cord, the first impregnating procedure. and the first drying and heat-treating procedure are applied to the cord, the cord is converted into a fabric and, thereafter, the second impregnating procedure is applied to the fabric.

The polymeric impregnating material impregnated in the substrate comprises at least the four components of:

(A) at least one polyepoxide compound,
(B) at least one rubber latex,
(C) at least one prepolymer of resorcin-formaldehyde reaction product and,
(D) at least one water-soluble polyurethane compound of the formula (I), and each of the four components is heat-treated on the substrate at least once independently from the others or together with one or more of the others at a temperature of 120° C. or more, but not exceeding the melting point of the polyester fiber material.

It is preferable that the entire dry weight of the polymeric impregnating material is in the range of from 0.1 to 10% based on the weight of the substrate.

The polyepoxide compound usable for the present invention contains at least two epoxy groups per molecule of the compound, the amount of the epoxy groups in the compound being a gram equivalent of 0.2 or more per 100 g of the compound. The polyepoxide compound may be selected from the group consisting of reaction products of polyhydric alcohols with halogenated epoxide compounds, reaction products of polyhydric phenol compounds with halogenated epoxide compounds and oxidation products of unsaturated organic compounds having at least one aliphatic double bond with peracetic acid or hydrogen peroxide. The above-mentioned polyhydric alcohol may be selected from the group consisting of ethylene glycol, glycerol, diglycerol, diethylene glycol, sorbitol, pentaerythritol trimethylol propane, polyethylene glycols, and polypropylene glycols. Also, the above-mentioned halogenated epoxide compound is epichlorohydrin. The polyhydric phenol compound mentioned above may be selected from the group consisting of resorcin, catechol, 2,2-bis(4-hydroxyphenyl)propane, bis(4-hydroxyphenyl)dimethylmethane, phenol-formaldehyde resins and resorcin-formaldehyde resins. Furthermore, the above-mentioned oxidation product may be selected from the group consisting of 4-vinyl cyclohexane dioxide, 3,4-epoxycyclohexylmethyl-3,4-epoxycyclohexene carboxylate and bis(3,4-epoxy-6-methyl cyclohexylmethyl)adipate. The preferred polyepoxide compound for the present invention may be selected from polyglycidyl ethers of polyhydric alcohols, which are reaction products of polyhydric alcohols with epichlorohydrin.

The above-mentioned polyepoxide compound may be used in the state of an aqueous emulsion or solution for the process of the present invention. In order to prepare the aqueous emulsion or solution, the polyepoxide compound is directly, or optionally after dissolving it in a small amount of a solvent, emulsified or dissolved in water, if necessary, in the presence of a surface active agent (emulsifying agent), for example, sodium alkylbenzene sulfonate.

It is preferred that the amount of the polyepoxide compound applied to the substrate is in the range of 0.05 to 2.0% based on the weight of the substrate.

When the polyepoxide compound is heat-treated at a temperature of 120° C. or more, preferably, 150° to 260° C. for 1 to 240 seconds, a portion of the polyepoxide compound penetrates into the polyester fibers and, the epoxy rings in the polyepoxide compound located in and on the polyester fibers are opened, and the ring-opened compound is polymerized in and on the polyester fibers. Therefore, the polyepoxide compound is converted into a hardened polymer firmly fixed in and on the polyester fibers.

The resorcin-formaldehyde reaction product usable for the present invention is an initial product of a condensation reaction of resorcin with formaldehyde preferably at a molar ratio of from 1:0.1 to 1:8, more preferably, from 1:0.5 to 1:5, still more preferably, from 1:1 to 1:4 in the presence of an alkali catalyst or an acid catalyst.

When heat-treated at a temperature of 120° C. or more, preferably, 120° to 250° C. for 30 to 240 seconds, the resorcin-formaldehyde prepolymer is converted into a completely polymerized resin on the substrate.

It is preferable that the dry weight of the resorcin-formaldehyde prepolymer applied to the substrate is in the range of from 0.01 to 5% based on the weight of the substrate.

The rubber latex usable for the present invention is selected from the group consisting of natural rubber latexes and synthetic rubber latexes. The synthetic rubber latexes include styrene-butadiene copolymer latexes, butadiene-vinyl pyridine copolymer latexes, vinyl pyridine-styrene-butadiene terpolymer latexes, acrylonitrile rubber latexes, acrylonitrile-butadiene copolymer latexes and chloroprene rubber latexes.

It is preferred that the amount of the rubber latex applied to the substrate is in the range of from 0.1 to 10% by dry weight based on the weight of the substrate.

The water-soluble polyurethane compound usable for the present invention is of the formula (I):

(II)

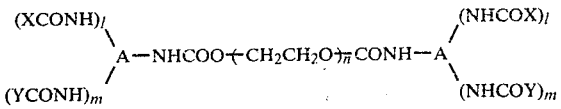

wherein A represents a tri- to hepta-valent radical; X represents a monovalent residue of a blocking compound having an activated hydrogen atom which residue is capable of dissociating from the polyurethane compound when said heat-treatment is applied thereto; Y represents a monovalent residue of an anionic group-forming compound selected from the group consisting of aminosulfonic acids having 2 to 6 carbon atoms and aminocarboxylic acids having 1 to 6 carbon atoms; n represents an integer of 5 to 30, and; l and m represent an integer of 1 to 5, respectively, and the sum of l and m is an integer of 2 to 6.

The water-soluble polyurethane compound of the formula (I) can be prepared by the process comprising the following stages.

A. Preparation of prepolymer

A polyisocyanate compound having 3 to 7 functional isocyanate radicals is brought into reaction with a polyethylene glycol compound having 5 to 30 oxyethylene $-(CH_2CH_2O)-$ groups and a molecular weight of about 200 to about 1300. In this reaction, it is preferred that the molar ratio of the polyisocyanate compound to the polyethylene glycol is adjusted to 2:1 so that the molar ratio of the isocyanate (—NCO) radical to the hydroxyl (OH) radical becomes 3:1 to 7:1, at a temperature of 150° C. or less, preferably, from 60° to 120° C., for one minute or more, usually, from several minutes to several hours.

B. Preparation of partially blocked prepolymer

The prepolymer is brought into reaction with a certain amount of a blocking agent having an activated hydrogen atom at a temperature of 50° to 90° C. in the presence of absence of an inert reaction medium, which is not reactive to the isocyanate radicals. The blocking reaction may be carried out by using a catalyst, for example, a basic catalyst such as triethylamine or an organic metal compound catalyst such as dibutyl-tin-dilaurate.

C. Introduction of water-soluble radical into the partially blocked prepolymer

The partially blocked prepolymer is brought into a reaction with a water-soluble compound having at least one activated hydrogen atom and at least one anion-forming radical at a temperature of 20° to 60° C. In the water-soluble compound, it is preferable that the anion-forming radical be converted into the form of a salt by using an organic basic compound, for example, primary, secondary or tertiary amine such as ethyl amine, triethylamine, dimethylamine or pyridine, or an alkoxylamine such as mono-, di- or tri-ethanol-amine; or; an inorganic basic compound, for example, hydroxide, carbonate or oxide of ammonia or an alkali metal. The water-soluble compound is added in the form of a solution in water or in an organic solvent to the reaction system. The water-soluble compound is selected from the group consisting of aminosulfonic acids having 2 to 6 carbon atoms and aminocarboxylic acids having 1 to 6 carbon atoms.

When the reaction is completed, the reaction mixture is diluted with water so as to form a transparent or slightly cloudy solution containing 10 to 50% by dry weight of the water-soluble polyurethane compound.

In the formula (I), the tri- to hepta-valent radical A is a residue of an organic polyisocyanate compound having 3 to 7 isocyanate radicals. The organic polyisocyanate compound may be selected from the group consisting of triphenylmethane triisocyanate, polymethylenepolyphenylisocyanate having 3 to 7 isocyanate groups, addition products of lower polyols having 3 or more hydroxyl groups with a diisocyanate compound and trimer of hexamethylene diisocyanate.

In the formula (I), the monovalent radical X is a residue of a blocking compound which has an activated hydrogen atom having been reacted with an isocyanate radical. The blocking compound may be selected from the group consisting of phenol compounds, aliphatic tertiary alcohol compounds, aromatic secondary amine compounds, aromatic imide compounds, lactam compounds, oxime compounds and sodium hydrogen sulfite.

The phenol compound usable as the blocking compound may be selected from the group consisting of phenol, thiophenol, alkyl phenols in which the alkyl group has 1 to 9 carbon atoms and resorcin.

The aliphatic tertiary alcohol compound may be selected from t-butyl alcohol and t-pentyl alcohol.

The aromatic secondary amine compound may be selected from diphenyl amine and xylidine.

The aromatic imide compound may be phthalic acid imide.

The lactam compound may be caprolactam or valerolactam.

The oxime compound may be selected from acetoxime, methylethylketone oxime and cyclohexaneoxime.

In the formula (I), it is preferred that the monovalent group X is of the formula;

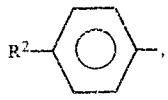

wherein $R^2$ represents an alkyl having 1 to 9 carbon atoms.

In the formula (I), the monovalent radical Y is derived from the anionic radical-containing compound selected from the group consisting of aminosulfonic acids having 2 to 6 carbon atoms, for example, taurine, N-methyl taurine and N-butyl taurine and ainocarboxylic acids having 1 to 6 carbon atoms, for example, glycine and alanine.

Also, in the formula, the number l of the groups of the formula, (XCONH)— and the number of the groups of the formula, (YCONH)— are 1 to 5, respectively, and the sum of l and m is 2 to 6, because the number of the valences of the radical A is 3 to 7. The number of the groups of the formula (YCONH)- must be 1 or more, but not exceeding 5, because the group is effective for making the polyurethane compound water-soluble.

The amount of the water-soluble polyurethane compound to be applied to the substrate is preferably in the range of from 0.1 to 10 % by dry weight based on the weight of the substrate.

The polymeric impregnating material may contain an additional component consisting of at least one member selected from the group consisting of ethylene urea compounds of the formula (II):

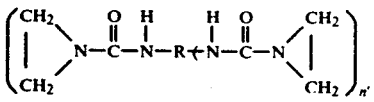

(II)

wherein R stands for an aromatic or aliphatic hydrocarbon residue and n' is 0,1 or 2, and blcoked polyisocyanate compounds of the formula (IV):

$$A'(NHCOX')_r \quad (IV)$$

wherein X' represents a residue of a blocking compound which residue is capable of dissociating from the blocked polyisocyanate compound when heat-treated, r represents an integer of 2 or more and A' represents an r valent radical.

The ethylene urea compound defined above may be a reaction product of ehtyleneimine with an isocyanate selected from the group consisting of octadecylisocyanate, hexamethylenediisocyanate, isophoronediisocyanate, tolylenediisocyanate, methaxylenediisocyanate, diphenylmethane diisocyanate, naphthylenediisocyanate, and triphenylmethanetriisocyanate. The most preferred ethylene urea compounds are aromatic ethylene urea compounds such as diphenylmethane diethylene urea.

The blocked polyisocyanate compound usable as the additional component is an addition product of a polyisocyanate with a blocking compound. The polyisocyanate may be selected from tolylene diisocyanate, methaphenylenediisocyanate, diphenylmethane diisocyanate, hexamethylene diisocyanate, polymethylenepolyphenylisocyanate, triphenylmethane triisocyanate and polyalkyleneglycol-adduct polyisocyanates which have been produced by the addition reaction of the above-mentioned polyisocyanate compounds with polyol compounds having two or more activated hydrogen atoms, for example, trimethylol propane, and pentaerythritol, in the molar ratio of the isocyanate radicals to the hydroxyl radicals of 1:1. The preferable polyisocyanate can be selected from aromatic polyisocyanate compounds, for example, tolylene diisocyanate, methaxylene diisocyanate, diphenylmethane diisocyanate and polymethylene polyphenylisocyanates.

The blocking compound can be selected from the group consisting of phenol compounds, for example, phenol, thiophenol, cresol, resorcin; aliphatic tertiary alcohols, for example, tert-butyl alcohol and tert-pentyl alcohol; aromatic secondary alcohols, for example, diphenyl amine and xylidine; aromatic imides, for example, phthalic acid imide; lactams, for example, caprolactam and valerolactam; oximes, for example, acetoxime, methylethylketoneoxime and cyclohexaneoxime, and; sodium hydrogen sulfite.

When the additional component is used, it is preferred that the amount of the additional component is in the range of from 0.5 to 10% by dry weight based on the weight of the substrate.

In the preparation of the polyester fiber composite material of the present invention, a substrate may be impregnated with a polymeric impregnation composition containing all of the above-mentioned four components and, optionally, the above-mentioned additional component and, then, the resultant impregnated substrate may be subjected to at least one heat-treatment at a temperature of 120° C. or more, but not exceeding the melting point of the polyester fiber material, preferably, from 150° to 260° C. Otherwise, the impregnating procedure may be carried out in two or more steps and the heat-treatment may be applied in two or more steps to each impregnated product. In this case, each impregnating liquid contains at least one component of the above-mentioned four components and the heat treatment is applied, after each impregnating procedure, to the impregnated substrate.

Each impregnating procedure can be carried out by using a coating roller, a spraying device, a dipping-squeezing apparatus or a brushing device. In order to adjust the amount of the impregnating material on the substrate to a desired value, an excessive amount of the impregnated material can be removed from the impregnated product by using a pair of squeezing rollers, a scraper, an air-blower, a suction device, an absorbing device or a beater.

In an embodiment of the polyester fiber composite material of the present invention, the substrate is first impregnated with a first impregnating material comprising the polyepoxide compound; the first impregnated polymeric material having been first heat-treated on the substrate at a temperature of 150° to 260° C., and; the first impregnated substrate is second impregnated with a second impregnating material comprising the water-soluble polyurethane compound of the formula (I), the resorcin-formaldehyde prepolymer and the rubber latex, the first and second impregnated polymeric materials having been second heat-treated together on the substrate at a temperature of 150° to 260° C.

The above-mentioned type of the polyester fiber composite material of the present invention is prepared by the process in which the substrate is first impregnated with a first impregnating liquid comprising the polyepoxide compound; the first impregnated product is dried and, then, first heat-treated at a temperature of 150° to 260° C.; the first heat-treated product is second impregnated with a second impregnating liquid containing the water-soluble polyurethane compound of the formula (I), the resorcin-formaldehyde prepolymer and the rubber latex, and; the second impregnated product is dried and, then, second heat-treated at a temperature of 150° to 260° C.

The first impregnation procedure can be carried out by applying the first impregnating liquid containing the polyepoxide component to any form of a polyester fiber material. For example, when a polyester is melt-spun, the resultant polyester filaments may be impregnated with a first impregnating liquid, in the stage in which a spinning oil is applied to the polyester filaments. Otherwise, the first impregnation procedure may be applied to the polyester filaments after a drawing procedure has been applied thereto, but before a winding procedure has been applied thereto. Also, the first impregnation procedure may be applied to the polyester fiber material in the form of a cord fabric or a woven fabric.

The polyepoxide compound is contained in the form of an aqueous solution or emulsion in the first impregnating liquid. In the preparation of the aqueous solution or emulsion, the polyepoxide compound is dissolved in a small amount of a solvent, for example, methyl alcohol or ethyl alcohol, and the solution is mixed with water in the presence or absence of an emulsifying agent, for example, sodium alkylbenzene sulfonate, sodium dioctylsulfosuccinate or an addition product of nonylphenol with ethylene oxide.

The first impregnated product is first heat-treated at a temperature of 150° to 260° C. for 1 to 240 seconds, by using a heating device, for example, a slit heater, over or heating roller.

When the first impregnating procedure has been applied to the melt-spun polyester filaments or the drawn polyester filaments, it is preferable that the first heat-treatment for the first impregnated product is effected in the stage where the melt-spun or drawn polyester filaments are heat-treated at a temperature of about 200° C.

During the first heat-treatment procedure, the polyepoxide compound penetrates into the inside of the polyester fibers, and the epoxy rings in the polyepoxide compound are opened so that the polyepoxide compound is polymerized, the polymerization product is firmly fixed within the fibers and on the surface of the fibers.

The first heat treatment of the first impregnating material containing the polyepoxide compound may be carried out in the presence of an epoxy hardening agent comprising at least one higher fatty acid-tert-amine compound of the formula (III):

$$R'-N\begin{matrix}(C_{n''}H_{2n''}O)_pH\\(C_{n''}H_{2n''}O)_qH\end{matrix} \qquad \text{(III)}$$

wherein R′ represents a member selected from the group consisting of unsaturated and saturated alkyls having 8 to 22 carbon atoms, n″ represents an integer of 2 or 3 and p and q represent an integer of 1 to 30, respectively.

Examples of the epoxy hardening tert-amine compound are as follows.

$$C_8H_{17}N\begin{matrix}(C_2H_4O)_pH\\(C_2H_4O)_qH\end{matrix}, \quad p+q=3$$

$$C_{12}H_{25}N\begin{matrix}(C_2H_4O)_pH\\(C_2H_4O)_qH\end{matrix}, \quad p+q=3$$

$$C_{12}H_{25}N\begin{matrix}(C_2H_4O)_pH\\(C_2H_4O)_qH\end{matrix}, \quad p+q=10$$

$$C_{12}H_{25}N\begin{matrix}(C_2H_4O)_pH\\(C_2H_4O)_qH\end{matrix}, \quad p+q=30$$

-continued $$C_{16}H_{33}N\begin{matrix}(C_2H_4O)_pH\\(C_2H_4O)_qH\end{matrix}, \quad p+q=20$$

and $$C_{18}H_{35}N\begin{matrix}(C_2H_4O)_pH\\(C_2H_4O)_qH\end{matrix}, \quad p+q=20$$

In the present invention, the above-mentioned type of higher fatty acid-tert-amine compounds are especially effective for hardening the polyepoxide compound so as to enhance the bonding property of the polyester fiber material to rubber without deteriorating the mechanical strength of the polyester fiber material.

The epoxy hardening agent may be contained together with the polyepoxide compound in the first impregnating liquid or may be applied in the melt-spinning process to the polyester fibers. In the latter case, the polyepoxide compound is applied to the polyester fibers after the drawing procedure. Usually, the epoxy hardening agent is used in an amount of 30 to 100% based on the weight of the polyepoxide compound.

In the case where, a first impregnating liquid containing both the polyepoxide compound and the epoxy hardening agent is applied to the substrate comprising the polyester fiber material, the first impregnated product is heat-treated and, then, may be directly subjected to the second impregnating procedure. However, in this case, it is preferable that the first impregnated and heat-treated product is aged at a temperature of 40° to 100° C. for 8 hours or more. This aging procedure is effective for enhancing the bonding property of the resultant product to rubber. That is, during the aging procedure, the penetration of the polyepoxide compound into the polyester fibers is accelerated and the ring-opening-polymerization of the polyepoxide compound is promoted by the action of the epoxy hardening agent. The resultant polymerization product of the polyepoxide compound is firmly fixed within and on the polyester fibers and exhibits an enhanced reactivity with the resorcin-formaldehyde prepolymer and the water-soluble polyurethane compound.

The second impregnating liquid contains the resorcin-formaldehyde prepolymer, the rubber latex and the water-soluble polyurethane compound of the formula (I).

The amount of the water-soluble polyurethane compound is preferably in the range of from 0.5 to 40%, more preferably, from 1.0 to 30%, by dry weight, based on the sum of the dry weights of the resorcin-formaldehyde prepolymer and the rubber latex. When the amount of the water-soluble polyurethane compound is less than 0.5%, the resultant product exhibits an unsatisfactory bonding property to rubber. Also, an excessive amount of the water-soluble polyurethane compound over 40%, may cause the resultant product to exhibit an excessively high stiffness and a poor processability.

The mixing ratio of the resorcin-formaldehyde prepolymer to the rubber latex is preferably in the range of from 1:1 to 1:15, more preferably, from 1:3 to 1:12. When the mixing ratio is smaller than 1:3, the resultant product, sometimes exhibits an excessively large stiffness and when the mixing ratio is larger than 1:12, the second impregnating liquid, sometimes, exhibits an undesirably large viscosity and the resultant product may exhibit a poor bonding property to rubber.

In the preparation of the second impregnating liquid, the resorcin-formaldehyde polymer may be aged together with the rubber latex (E) at a temperature of from 16° to 25° C. for 16 hours or more, so as to allow them to react with each other and to provide a so-called "RFL" resin.

Also, in the preparation of the second impregnating liquid, an aqueous solution of the water-soluble polyurethane compound of the formula (I) is mixed with the rubber latex and, then, with the resorcin-formaldehyde prepolymer. Otherwise, an aqueous solution of the water-soluble polyurethane compound is mixed with the resorcin-formaldehyde prepolymer and, then, with the rubber latex. Or, the resorcin-formaldehyde prepolymer is mixed with the rubber latex, and the mixture RFL is mixed, before or after the aging procedure, with an aqueous solution of the water-soluble polyurethane compound. The second impregnating liquid may be aged or may not be aged, before the second impregnating procedure.

The dry concentration of the sum of the water-soluble polyurethane compound, the rubber latex and the resorcin-formaldehyde prepolymer in the second impregnating liquid is preferably in the range of 10 to 25% by weight. This dry concentration is adjusted so that the dry solid content of the second impregnating liquid impregnated into the first heat-treated product becomes 1 to 10%, preferably, 2 to 8%, based on the weight of the substrate.

In another embodiment of the polyester fiber composite material of the present invention, a substrate is impregnated with a first impregnating composition comprising the polyepoxide compound, the water-soluble polyurethane compound of the formula (I) and the rubber latex, the first impregnating composition having been first heat treated on the substrate at a temperature of 180° C. or more, but not exceeding the melting point of the polyester fiber material; and the first impregnated substrate is second impregnated with a second impregnating composition comprising the resorcin-formaldehyde prepolymer and the rubber latex, the first and second impregnating compositions having been second heat-treated together on the substrate at a temperature of 120° C. or more, but not exceeding the melting point of the polyester fiber material.

The above-mentioned type of polyester fiber composite material is produced by a process in which a substrate is first impregnated with a first impregnating liquid containing the polyepoxide compound, the water-soluble polyurethane compound of the formula (I) and the rubber latex; the first impregnated product is dried and, then, first heat-treated at a temperature of 180° C. or more, but not exceeding the melting point of the polyester fiber material; the first heat-treated product is second impregnated with a second impregnating liquid containing the resorcin-formaldehyde prepolymer and the rubber latex and; the second impregnated product is dried and, then, second heat-treated at a temperature of 120° C. or more, but not exceeding the melting point of the polyester fiber material; the first heat treated product is second impregnated with a second impregnating liquid containing the resorcin-formaldehyde prepolymer and the rubber latex, and; the second impregnated product is dried and, then, second heat-treated at a temperature of 120° C. or more, but not exceeding the melting point of the polyester fiber material.

In the first impregnating liquid, it is preferable that the ratio in weight of the polyepoxide compound to the sum of the polyoxide compound and the water-soluble polyurethane compound of the formula (I) is in the range of from 0.05:1 to 0.9:1, more preferably, from 0.1:1 to 0.5:1. When the above-mentioned ratio falls outside of the above-specified range, the resultant product may exhibit an unsatisfactory bonding property to rubber.

Also, it is preferable that the ratio in weight of the rubber latex to the sum of the polyepoxide compound and the water-soluble polyurethane compound of the formula (I) is in the range of from 0.5:1 to 15:1, more preferably, from 1:1 to 10:1.

If the above-mentioned ratio is below the above-specified range, the resultant product sometimes exhibits an excessive stiffness and a reduced resistance to fatigue. If the ratio is above the above-specified range, the resultant product may exhibit an unsatisfactory bonding property to rubber.

Usually, the dry solid concentration of the sum of the polyepoxide compound, the water-soluble polyurethane compound and the rubber latex in the first impregnating liquid is in the range of from 1 to 30% by weight, preferably, 3 to 20% by weight. A dry solid concentration of less than 1% by weight may result in a product having a poor bonding property to rubber. Also, a dry solid concentration of more than 30% by weight may cause the resultant product to exhibit an excessive stiffness and a reduced resistance to fatigue.

The first impregnated product is dried and, then, first heat-treated at a temperature of 180° C. or more, but not exceeding the melting point of the polyester fiber material, preferably, from 220° to 250° C. for 30 to 240 seconds.

Also, it is preferable that when the first heat-treatment is completed, the substrate is impregnated with the first impregnating composition in a dry weight of 0.1 to 10%, more preferable 0.5 to 5% based on the weight of the substrate.

The second impregnating liquid contains the resorcin-formaldehyde prepolymer and the rubber latex which may be the same as or different from the rubber latex contained in the first impregnating liquid. In this case, it is preferable that the rubber latex in the second impregnating liquid contains at least 50% by weight of a vinyl pyridine-butadiene-styrene terpolymer latex.

The mixing ratio in dry weight of the resorcin-formaldehyde prepolymer to the rubber latex is preferably in the range of 1:1 to 1:15, more preferably, 1:3 to 1:12. When the mixing ratio is below 1:1, the resultant product may exhibit an excessive stiffness and an unsatisfactory resistance to fatigue.

If the mixing ratio is above 1:15, the resultant product may exhibit an unsatisfactory bonding property to rubber.

The mixture of the resorcin-formaldehyde prepolymer and the rubber latex may be aged in the above-mentioned manner before the second impregnating procedure.

The second impregnating liquid optionally contains an additional component consisting of at least one member selected from the group consisting of the ethylene urea compounds of the formula (II), the blocked polyisocyanate compounds of the formula (IV) and the water-soluble polyurethane compounds of the formula (I).

The additional component is used preferably in an amount of from 0.5 to 30%, more preferably, from 1.0 to 20%, based on the total weight of the resorcin-formaldehyde prepolymer and the rubber latex. If the additional component is used in an excessive amount, the resultant second impregnating liquid, sometimes, exhibits an excessive viscosity which causes the impregnating procedure to be difficult, and the resultant product, sometimes, exhibits an excessive stiffness and an unsatisfactory mechanical strength. Also, the resultant product becomes expensive to produce.

The additional component is activated in the second heat-treatment procedure so as to react with the first heat-treated polyepoxide compound and the water-soluble polyurethane compound on the substrate and to accelerate the coagulation of the resorcin-formaldehyde prepolymer and the rubber latex in the second impregnating composition. The activated additional component is reactive to rubber. Therefore, the additional component is effective for increasing the bonding property of the resultant product to the rubber without increasing the stiffness of the resultant product.

In the case where the second impregnating liquid contains an additional component, it is preferred that the dry solid concentration of the second impregnating liquid is in the range of from 10 to 25% by weight.

The dry solid concentration should be adjusted to a desired value which will cause, when the second heat-treatment is completed, the dry weight of the second impregnating composition impregnated in the substrate becomes 0.5 to 10%, preferably, 1 to 5% based on the weight of the substrate.

The second impregnated product is dried and, then, second heat-treated at a temperature of 120° C. or more, but not exceeding the melting point of the polyester fiber material, preferably, 180° to 250° C., for 30 to 240 seconds.

In the other embodiment of the polyester fiber composite material of the present invention, a substrate comprising a polyester fiber material, is impregnated with three layers of impregnating composition. That is, the substrate is first impregnated with a first impregnating material comprising the polyepoxide compound, the first impregnating material having been heat-treated on the substrate at a temperature of 150° to 260° C.; the first impregnated product is second impregnated with a second impregnating material comprising the water-soluble polyurethane compound of the formula (I), the first and second impregnating materials having been heat-treated together on the substrate at a temperature of 180° C. or more, but not exceeding the melting point of the polyester fiber material, and; the second impregnated product is then impregnated with a third impregnating material comprising the resorcin-formaldehyde prepolymer and the rubber latex, the first, second and third impregnated materials having been heat-treated at a temperature of 120° C. or more but not exceeding the melting point of the polyester fiber material.

The above-mentioned type of polyester fiber composite material can be produced by a process in which the substrate is first impregnated with a first impregnating liquid containing the polyepoxide compound; the first impregnated product is dried and, then, first heat-treated at a temperature of 150° to 260° C., the first heat-treated product is then impregnated with a second impregnating liquid containing the water-soluble polyurethane compound of the formula (I) to form a twice impregnated product; the twice impregnated product is dried and, then, heat-treated at a temperature of 180° C. or more, but not exceeding the melting point of the polyester fiber material; the twice heat-treated product is then impregnated with a third impregnating liquid containing the resorcin-formaldehyde prepolymer and the rubber latex, and; the three times impregnated product is dried and, then, heat-treated at a temperature of 120° C. or more, but not exceeding the melting point of the polyester fiber material.

In the first impregnating procedure, the first impregnating liquid is applied to the substrate so that the dry weight of the polyepoxide compound impregnated into the substrate becomes 0.05 to 2.0% based on the weight of the substrate. The concentration of the polyepoxide compound in the first impregnating liquid is preferable in the range of from 0.5 to 30%.

The first impregnating liquid may contain, in addition to the polyepoxide compound, an epoxy hardening agent in an amount of 5 to 30% based on the dry weight of the polyepoxide compound.

The first impregnated product is dried and, then, heat-treated at a temperature of 150° to 260° C. for 1 to 240 seconds to form a first heat treated product.

When the first impregnated product contains the epoxy hardening agent, it is preferable that the first heat-treated product is aged at a temperature of 40° to 100° C. for 8 hours or more to enhance the bonding property of the resultant product to the rubber. However, the aging procedure may be omitted.

The second impregnating liquid comprises the water-soluble polyurethane compound of the formula (I) and, optionally, the polyepoxide compound which may be the same as or different from the polyepoxide component contained in the first impregnating liquid. It is preferable that the dry solid concentration of the second impregnating liquid is in the range of from 1 to 30% by weight, more preferably, 3 to 20% by weight, and that the dry weight of the polyepoxide compound in the second impregnating liquid is 0.5 to 30%, more preferably, 1.0 to 20%, based on the dry weight of the water-soluble polyurethane compound.

In the second impregnating procedure, it is preferable that the dry weight of the water-soluble polyurethane compound impregnated into the substrate is in the range of 0.1 to 10%, more preferably, 0.5 to 5%, based on the weight of the substrate.

The twice impregnated product is dried and, then, heat-treated at a temperature of 180° C. or more, but not exceeding the melting point of the polyester fiber material, preferably, 220° to 250° C., for 30 to 240 seconds.

The third impregnating liquid contains the resorcin-formaldehyde prepolymer and the rubber latex. The ratio in weight of the resorcin-formaldehyde prepolymer to the rubber latex is preferable in the range of from 1:1 to 1:15, more preferred, 1:3 to 1:12. Also, it is preferable that the dry solid concentration of the sum of the resorcin-formaldehyde prepolymer and the rubber latex in the third impregnating liquid is in the range of 5 to 25% by weight, more preferably, 10 to 20% by weight.

The third impregnating liquid may contain an additional component consisting of at least one member selected from the group consisting of ethylene urea compounds of the formula (II), the blocked polyisocyanate compounds of the formula (IV) and the water-soluble polyurethane compounds of the formula (I). The amount of the additional component is preferably in the range of 0.5 to 30%, more preferably, 1.0 to 20%, based on the dry weight of the sum of the resorcin-formaldehyde prepolymer and the rubber latex.

The additional component is effective for promoting the firm bonding of the third impregnating composition to the first and second impregnating compositions applied to the substrate and for enhancing the bonding property of the resultant product to the rubber without excessively increasing the stiffness of the resultant product. The third impregnating liquid is impregnated into the substrate so that the dry weight of the third impregnating composition contained in the substrate corresponds to 0.5 to 10%, more preferably, 1 to 5%, of the weight of the substrate.

The three times impregnated product is dried and, then, third heat-treated at a temperature of 120° C. or more, but not exceeding the melting point of the polyester fiber material, preferably, 180° to 250° C., for 30 to 240 seconds.

The above-mentioned type of polyester fiber composite material of the present invention has a relatively high stiffness which is proper as a reinforcing material for a raw edge type V-belt, and an excellent bonding property to rubber.

In the present invention, it is essential that the water-soluble polyurethane compound is of the formula (I). Since the polyurethane compound is water-soluble, it is easy to obtain an impregnating liquid in which the water-soluble polyurethane compound is contained uniformly and which is stable over a long period of time. Accordingly, the substrate can be uniformly impregnated by the impregnating liquid containing the water-soluble polyurethane compound. This feature is effective for making the bonding property of the resultant product to the rubber uniform. Also, when the water-soluble polyurethane compound is heat-treated on the substrate, the group X derived from the blocking compound, is easily dissociated from the polyurethane compound so as to provide one or more activated isocyanate radicals in the molecules of the polyurethane compound. This activated polyurethane compound is polymerized, and reacts with the heat-treated polyepoxide compound in and/or on the substrate and also promotes the coagulation of the resorcin-formaldehyde prepolymer and the rubber latex, so as to form a polymeric coating layer firmly fixed to the polyester fibers and having an excellent bonding property to the rubber.

The polyester fiber composite material of the present invention is very useful as a reinforcing material for rubber articles, for example, tires, belts and V-belts. That is, the reinforcing polyester fiber composite material of the present invention has an excellent tensile strength, dimensional stability, and other properties required for reinforcing materials. Also, the reinforcing material of the present invention exhibits a proper softness and, therefore, has a high processability in the shaping or molding process and a high resistance to fatigue fracture. Furthermore, when embedded and vulcanized in a rubber composition, the reinforcing polyester fiber composite material of the present invention exhibits an excellent bonding property to rubber and a high rubber coverage.

The specific examples presented below will serve to more fully explain how the present invention is practiced. However, it will be understood that these examples are only illustrative and in no way limit the present invention.

In the examples, the following tests were carried out on the resultant products.

1. Peeling resistance

Two tire cords each having a density of 27 threads/2.5 cm were superimposed on each other at an angle of 90 degrees from each other and treated in accordance with the process of the present invention. The resultant reinforcing ply embedded within a rubber composition for producing a carcass of a tire for an automobile. The rubber composite article thus prepared was subjected to a vulcanizing operation in a press at a temperature of 160° C. for 20 minutes.

In order to determine the bonding strength of the reinforcing ply to rubber, the reinforcing ply was peeled off from the rubber matrix at a rate of 200 mm/minute. The load required to peel off the reinforcing ply from the rubber matrix was measured in kg/3c.

2. Rubber coverage

After the above-mentioned reinforcing ply was peeled off from the rubber matrix, the surface of the reinforcing ply was observed with the naked eye, the percentage of a total area of portions of the reinforcing ply surface covered by the rubber based on the whole area of the surface was determined.

3. Resistance to bending

The resistance of the above-mentioned reinforcing ply to bending was determined by using a Gurley type stiffness tested disclosed in U.S. Pat. No. 3,575,761.

4. Resistance to fatigue

A test specimen was placed between rotating disks of a Goodrich type disk tester and repeatedly subjected 3.5 million times to stretching at a percent elongation of 6% and compressing at a percent compression of 18%. The tensile strength ($X_0$) of the specimen before testing was determined, and after the completion of the testing process, the remaining tensile strength ($X_1$) of the specimen was determined. The percentage of the remaining tensile strength of the specimen after the testing process based on that before testing was calculated in accordance with the equation:

$$\text{Remaining tensile strength}(\%) = (X_1/X_0) \times 100$$

5. T-bonding strength

A cord was embedded at a depth of 1 cm within a rubber block and the cord-containing rubber block was vulcanized at a temperature of 150° C. for 30 minutes while pressing it.

In order to determine the T-bonding strength of the cord to rubber, the cord was pulled out from the rubber block at a speed of 200 mm/min.

The T-bonding strength of the cord to rubber was represented by the load in kg/cm necessary to pull out the cord from the rubber block.

6. CRA-bonding strength

Fine cords were embedded within a surface layer of a rubber sheet and the cord-containing rubber sheet was vulcanized at a temperature of 150° C. for 30 minutes while pressing it.

In order to determine the CRA-bonding strength, the fine cords were peeled from the surface layer of the rubber sheet at a rate of 200 mm/min. The CRA-bonding strength of the cords to the rubber sheet was represented by the load in kg/5 cords applied to the cords.

EXAMPLE 1 AND COMPARATIVE EXAMPLES 1 TO 3

In Example 1, a polyethylene terephthalate resin was melt-spun at a temperature of 288° C., and an oiling liquid containing a first impregnation composition consisting of 5% by weight of ethyleneglycol diglycidylether and an epoxy hardening agent consisting of laurylamine-ethylene oxide addition product in an amount of 10% based on the weight of the ethyleneglycol diglycidylether, was applied to the melt-spun polyester filaments so that the dry weight of the ethyleneglycol diglycidylether taken up by the filaments corresponded to 0.5% of the dry weight of the filaments. The oiled, first impregnated polyester filaments were drawn at a draw ratio of 5 and heat-set at a temperature of 200° C. A polyester multifilament yarn having a yarn count of 1000 denier/250 filaments was obtained.

Separately, a water-soluble polyurethane compound was prepared as follows.

A mixture of 79 parts by weight of hexamethylene diisocyanate, 21 parts by weight of trimethylol propane, and 23.5 parts by weight of a polyethylene glycol having an average molecular weight of 300, was placed in a reaction flask and subjected to a reaction at a temperature of 90° C. for 120 minutes. A urethane prepolymer containing 10.75% (theoretically 10.66%) of free isocyanate radicals was obtained.

The resultant urethane prepolymer was cooled to a temperature of 60° C. and mixed with 25 parts by weight of phenol. The mixture was subjected to a reaction at a temperature of 150° C. for 180 minutes while stirring the reaction mixture. The reaction mixture was cooled to 80° C. and mixed with 37 parts by weight of dioxane. A solution of a partially blocked urethane prepolymer containing 1.72% of free isocyanate radicals in dioxane, was obtained in an amount of 185.5 parts by weight. The solution of the partially blocked urethane prepolymer in dioxane was mixed with 49.6 parts by weight of an aqueous solution of 15% by weight of sodium salt of taurine, and the mixture was subjected to a reaction at a temperature of 40° C. for 30 minutes. Thereafter, 284.4 parts by weight of water were added to the reaction mixture. A diluted aqueous solution containing 30% by weight of a water-soluble polyurethane compound was obtained in an amount of 519.5 parts by weight.

An aqueous solution was prepared by mixing 10 g of an aqueous solution of 10% by weight of sodium hydroxide and 30 g of an aqueous solution of 28% of ammonia into 260 g of water while stirring the mixture.

A resorcin-formaldehyde prepolymer was prepared at a molar ratio of resorcin to formaldehyde of 1:1 in the presence of an acid catalyst. 60 g of a 40% solution of the resorcin-formaldehyde prepolymer in acetone was uniformly mixed with the aqueous solution by stirring the mixture, to prepare a resorcin-form aldehyde prepolymer solution.

Separately, a mixture was prepared from 240 g of a 40% vinyl pyridine-styrene-butadiene terpolymer latex which is available under the trademark of NIPPOL 2518FS, from NIPPON ZEON CO., 100 g of a 40% styrene-butadiene copolymer latex which is available under the trademark of NIPPOLLX-112, from NIPPON ZEON CO., and 200 g of water, and the mixture was homogenized by stirring it. The above-mentioned resorcin-formaldehyde prepolymer solution was gradually mixed with the latex mixture while stirring the resultant mixture, and 20 g of 37% formaldehyde aqueous solution was added to the mixture. An RFL liquid was produced.

The RFL liquid was mixed with 80 g of a 25% aqueous solution of the water-soluble polyurethane compound aqueous solution, containing 7.5% by dry weight of the water-soluble polyurethane compound. The mixture was aged at a temperature of 20° C. for 48 hours. A second impregnating liquid was obtained.

A cord was produced by first twisting the first impregnated polyester filament yarn at a first twisting number of 40 turns/10 cm and, then, by finally twisting three of the first twisted polyester fiber yarns together at a final twisting number of 40 turns/10 cm.

The cord was continuously impregnated with the second impregnating liquid by using a tire cord-treating machine which is available under the trademark of COMPUTREATER, from C. A. RITZLER CO., so that the amount of the second impregnating liquid picked up by the cord fabric becomes 6% based on the weight of the cord fabric. The second impregnated cord fabric was dried at a temperature of 100° C. for 120 seconds and, then, heat-treated at a temperature of 230° C. for 120 seconds.

The cord obtained as mentioned above was subjected to the tests of the peeling resistance, rubber coverage, T-bonding strength and CRA-bonding strength. The results are shown in Table 1.

In Comparative Example 1, the same procedures as those mentioned in Example 1 were carried out, except that the oiling liquid contained no ethyleneglycol diglycidylether and no laurylamine-ethylene oxide addition product.

In Comparative Example 2, the same procedures as those mentioned in Example 1 were carried out, except that no water-soluble polyurethane compound was used.

In Comparative Example 3, the same procedures as those mentioned in Example 1 were carried out, except that no resorcin-formaldehyde prepolymer was used.

TABLE 1

| Example No. | | T-bonding strength (kg/cm) | CRA-bonding (kg/5 cords) | Peeling resistance (kg/3 c) | Rubber coverage (%) |
|---|---|---|---|---|---|
| Example | 1 | 18.5 | 14.3 | 33 | 70 |
| Comparative | 1 | 4.0 | 1.5 | 7 | 0 |
| Example | 2 | 13.0 | 9.5 | 24 | 30 |
| | 3 | 5.0 | 2.0 | 7 | 0 |

Table 1 clearly shows that the product of Example 1 exhibits a superior bonding property to rubber to that of Comparative Examples 1 to 3.

EXAMPLE 2

The same procedures as those described in Example 1 were carried out, except that the first impregnated, first heat-treated polyester filament yarn was aged at a temperature of 50° C. for 4 days.

The resultant cord exhibited the following properties:

| | |
|---|---|
| T-bonding strength | 19.5 kg/cm |
| CRA-bonding strength | 14.5 kg/5 cords |
| Peeling resistance | 35 kg/3 cm |
| Rubber coverage | 80% |

The bonding property of the product of Example 2 was superior to that of Example 1, due to the aging procedure applied to the first impregnated polyester filament yarn.

EXAMPLE 3

The same procedures as those described in Example 1 were carried out, except that the water-soluble polyurethane compound was prepared by the following process.

A mixture of 100 parts by weight of a methylene-linked polyphenylpolyisocyanate containing 29.3% of isocyanate radical with 42 parts by weight of a polyethylene glycol having an average molecular weight of 600 was placed in a reaction flask and subjected to an addition reaction at a temperature of 70° C. for 120 minutes. The resultant product was an urethane prepolymer containing 16.39% of free isocyanate radicals (theoretical value=16.49%).

The resultant prepolymer was cooled to 50° C. and mixed with 86.3 parts by weight of octylphenol. The mixture was subjected to a reaction at a temperature of 120° C. for 180 minutes. The reaction mixture was cooled to 80° C. and mixed with 71 parts by weight of dioxane. A solution of the resultant partially blocked prepolymer having a content of free isocyanate radicals of 3.96% in dioxane was obtained in an amount of 299.3 parts by weight.

The partially blocked prepolymer solution was subjected to a reaction with 131.3 parts by weight of an aqueous solution of 15% by weight of sodium salt of taurine at a temperature of 40° C. for 30 minutes. Thereafter, 561.4 parts by weight of water were added to the reaction mixture. An aqueous solution containing 25% by dry weight of the resultant heat-reaction type water-soluble polyurethane compound was obtained in an amount of 992 parts by weight.

The results of the tests are indicated in Table 2.

EXAMPLE 4

The same procedures as those described in Example 1 were carried out, except that the water-soluble polyurethane compound used was one prepared by the following process.

A mixture of 52.2 parts by weight of tolylene diisocyanate, 13.4 parts by weight of trimethylol propane and 50 parts by weight of a polyethylene glycol having an average molecular weight of 1,000 was placed in a reaction flask and subjected to an addition reaction at a temperature of 80° C. for 90 minutes. An urethane prepolymer containing 7.23% of free isocyanate radicals (theoretical value=7.27%) was obtained.

The resultant prepolymer was cooled to 60° C. and mixed with 15 parts by weight of phenol. The mixture was subjected to a blocking reaction at a temperature of 120° C. for 180 minutes and, then, cooled to 80° C. The cooled reaction mixture was diluted with 57.8 parts by weight of dioxane to provide 188.4 parts by weight of a solution of a partially blocked prepolymer containing 6.51% of free isocyanate radicals in dioxane.

The partially blocked prepolymer solution was mixed with 20.1 parts by weight of an aqueous solution of 20% by weight of sodium salt of glycine. The mixture was subjected to a blocking reaction at a temperature of 40° C. for 30 minutes. Thereafter, the reaction mixture was gradually diluted with 330 parts by weight of water. The resultant product was 538.5 parts by weight of an aqueous solution containing 25% by dry weight of a heat-reaction type water-soluble polyurethane compound.

The results of the tests are indicated in Table 2.

EXAMPLES 5 TO 8

In each of the Examples 5 to 8, the same procedures as those described in Example 4 were carried out, except that in the preparation of the water-soluble polyurethane compound, the tolylene diisocyanate was replaced by the isocyanate compound as indicated in Table 2.

The results of the tests are indicated in Table 2.

TABLE 2

| Example No. | Components of urethane prepolymer: Isocyanate compound | Components of urethane prepolymer: Hydroxyl compound | T-bonding strength (kg/cm) | CRA-bonding (kg/5 cords) | Peeling resistance (kg/3 c) | Rubber coverage (%) |
|---|---|---|---|---|---|---|
| 3 | Polymethylene polyphenylene-isocyanate | Polyethylene glycol (MW = 600) | 19.5 | 15.0 | 36 | 70 |
| 4 | Tolylene diisocyanate | Trimethylol propane Polyethylene glycol | 19.0 | 14.5 | 35 | 70 |
| 5 | Xylylene diisocyanate | Trimethylol propane Polyethylene glycol | 18.5 | 14.0 | 34 | 70 |
| 6 | Hexamethylene diisocyanate | Trimethylol propane Polyethylene glycol | 17.0 | 13.5 | 31 | 60 |
| 7 | Diphenylmethane diisocyanate | Trimethylol propane Polyethylene glycol | 18.5 | 14.0 | 33 | 70 |
| 8 | Isophorone diisocyanate | Trimethylol propane Polyethylene glycol | 17.5 | 13.0 | 30 | 60 |

EXAMPLES 9 AND 10 AND COMPARATIVE EXAMPLES 4 AND 5

In Example 9, an aqueous solution of a polyepoxide compound was prepared by uniformly dissolving 6 g of sorbitol polyglycidyl ether which is available under the trademark of DECONAL EX-611, from NAGASE SANGYO CO., JAPAN, in 805 g of water together with 4 g of an aqueous solution containing 30% by weight of sodium dioctylsulfosuccinate which is available under the trademark of NEDCOL SW-300, from DAIICHIE KOGYO SEIYAKU CO., JAPAN, while vigorously stirring the mixture.

An aqueous solution of a water-soluble polyurethane compound was prepared in the following manner.

A mixture of 79 parts by weight of hexamethylene diisocyanate, 21 parts by weight of trimethylol propane and 23.5 parts by weight of a polyethylene glycol having an average molecular weight of 300, was placed in a reaction flask and subjected to an addition reaction at a temperature of 90° C. for 120 minutes. The resultant urethane prepolymer contained 10.75% of free isocyanate radicals (theoretical value = 10.66%).

The prepolymer was cooled to 60° C., and mixed with 25 parts by weight of phenol. The mixture was subjected to a blocking reaction at a temperature of 150° C. for 180 minutes.

The reaction mixture was cooled to 80° C. and, then, diluted with 37 parts by weight of dioxane. The resultant product was 185.5 parts by weight of a solution of a partially blocked urethane prepolymer containing 1.72% of free isocyanate radicals, in dioxane.

The solution of the partially blocked prepolymer was mixed with 49.6 parts by weight of an aqueous solution of 15% by weight of sodium salt of taurine. The mixture was subjected to a blocking reaction at a temperature of 40° C. for 30 minutes, and, thereafter, diluted with 284.4 parts by weight of water. The resultant product was 519.5 parts by weight of a aqueous solution containing 30% by weight of a heat-reaction-type water-soluble polyurethane compound (I).

A first impregnating liquid was prepared by mixing the above-mentioned aqueous solution of the polyepoxide compound with 56 g of an aqueous solution containing 25% by weight of the above-mentioned aqueous solution of the water-soluble polyurethane compound, that is, containing 7.5% by dry weight of the water-soluble polyurethane compound, and with 200 g of a rubber latex containing 40% by dry weight of a vinyl pyridine-styrene-butadiene terpolymer, which is available under the trademark of NIPPOL 2518FS, from NIPPON ZEON CO..

A second impregnating liquid was prepared in the following manner.

A resorcin-formaldehyde prepolymer was prepared by heating a mixture of 22 g of resorcin with 31 g of an aqueous solution of 37% by weight of formaldehyde, 31 g of an aqueous solution of 28% by weight of ammonia and 500 g of water, at a temperature of 25° C. for 3 hours while stirring the mixture. The resultant resorcin-formaldehyde prepolymer solution was mixed with 418 g of NIPPOL 2518FS and the mixture was aged at a temperature of 28° C. for 48 hours while slowly stirring the mixture, to provide an RFL liquid.

A cord which was composed of two polyethylene terephthalate filament yarns, each having a first twisting number of 40 turns/10 cm and which had a ply twisting number of 40 turns/10 cm and a latex of 1667/2 ply, was continuously first impregnated with the first impregnating liquid by using the continuous tire cord treating machine as that mentioned in Example 1, so that the cord picked up 2.5% by dry weight of the mixture of the polyepoxide compound, the water-soluble polyurethane compound and the rubber latex, based on the weight of the cord. The first impregnated cord was dried at a temperature of 150° C. for 2 minutes and, then, first heat-treated at a temperature of 230° C. for one minute.

The first heat-treated product was second impregnated with the second impregnating liquid so that the cord picked up 2.3% by dry weight of the RFL based on the weight of the cord. The second impregnated product was dried at a temperature of 150° C. for 2 minutes and, the, second heat-treated at a temperature of 230° C. for one minute.

The resultant polyester fiber composite cord was subjected to the tests of peeling resistance, rubber coverage, tensile strength, resistance to bending and resistance to fatigue. The results are indicated in Table 3.

In Comparative Example 4, procedures identical to those described in Example 9 were carried out, except that the first impregnating liquid contained no Deconal EX-611 (sorbitol polyglycidyl ether).

In Comparative Example 5, the same procedures as those described in Example 9 were carried out, except that the first impregnating liquid contained no water-soluble polyurethane compound (I).

In Example 10, the same procedures as those mentioned in Example 9 were carried out, except that the first impregnating liquid contained no rubber latex.

From Table 3, it is evident that the products of Comparative Example 4 and 5 exhibited a poor bonding property to rubber.

TABLE 3

| Example No. | | Content of components in first impregnating liquid (% by weight) | | | Peeling resistance (kg/3 cm) | Rubber coverage (%) | Tensile strength (kg) | Resistance to bending (mg) | Resistance to fatigue (%) |
|---|---|---|---|---|---|---|---|---|---|
| | | Poly-epoxide compound | Water-Soluble poly-urethane compound | Rubber latex | | | | | |
| Example | 9 | 0.6 | 1.4 | 8.0 | 33 | 70 | 22.5 | 1200 | 93 |
| Comparative | 4 | — | 1.4 | 8.0 | 23 | 20 | 22.5 | 650 | 93 |
| Example | 5 | 0.6 | — | 8.0 | 26 | 30 | 22.3 | 1000 | 92 |
| Example | 10 | 0.6 | 1.4 | — | 31 | 60 | 21.7 | 1800 | 87 |

Table 3 shows that in Example 10, the lack of the rubber latex in the first impregnating liquid caused the resultant product to exhibit an increased resistance to bending, that is, it exhibits excessive stiffness.

EXAMPLES 11 TO 16

In each of the Examples 11 to 16, the same procedures as those mentioned in Example 9 were carried out with the following exception.

In Example 11, the first impregnating liquid contained diglycerine diglycidyl ether in place of the sorbitol polyglycidyl ether (Deconal EX-611).

In Example 12, the first impregnating liquid contained pentaerythritol diglycidyl ether in place of the sorbitol polyglycidyl ether.

In Example 13, the water-soluble polyurethane compound (I) was replaced by the same one as that prepared in Example 4, which will be referred to as water-soluble polyurethane compound (II) hereinafter.

In Example 14, the water-soluble polyurethane compound (I) was replaced by the same one as that prepared in Example 3, which will be referred to as water-soluble polyurethane compound (III).

In Example 15, the first impregnating liquid contained a rubber latex containing a styrene-butadiene copolymer, in place of NIPPOL 2518FS.

In Example 16, the first impregnating liquid contained a rubber latex containing natural rubber, in place of NIPPOL 2518FS.

The results of the tests applied to the products of Examples 11 to 16 are indicated in Table 4.

TABLE 4

| Example No. | Resistance to peeling (kg/3 cm) | Rubber coverage (%) | Tensile strength (kg) | Resistance to bending (mg) | Resistance to fatigue (%) |
|---|---|---|---|---|---|
| 11 | 31 | 40 | 22.9 | 1000 | 92 |
| 12 | 33 | 60 | 22.6 | 1300 | 92 |
| 13 | 33 | 60 | 22.3 | 1200 | 92 |
| 14 | 32 | 60 | 22.3 | 1400 | 90 |
| 15 | 29 | 50 | 22.4 | 1300 | 91 |
| 16 | 24 | 40 | 22.5 | 1200 | 94 |

EXAMPLES 17 TO 21

In each of the Examples 17 to 21, the same procedures as those described in Example 9 were carried out except that the second impregnating liquid contained 20 g of an aqueous dispersion or solution containing 20% by weight of an additional component consisting of a compound as described below, in addition to 180 g of the RFL liquid.

Example 17: Blocking reaction product of 4,4'-diphenylmethane diisocyanate with ε-caprolactam Example 18: Blocking reaction product of 4,4'-diphenylmethane diisocyanate with phenol Example 19: Diphenylmethane diethyleneurea Example 20: Triphenylmethane triethyleneurea Example 21: The water-soluble polyurethane compound described in Example 9.

The results of the tests applied to the products of Examples 17 to 21 are indicated in Table 5.

TABLE 5

| Example No. | Resistance to peeling (kg/3 cm) | Rubber coverage (%) | Tensile strength (kg) | Resistance to bending (mg) | Resistance to fatigue (%) |
|---|---|---|---|---|---|
| 17 | 32 | 70 | 22.3 | 1300 | 92 |
| 18 | 33 | 70 | 22.2 | 1400 | 92 |
| 19 | 35 | 80 | 22.1 | 1500 | 91 |
| 20 | 33 | 80 | 22.1 | 1400 | 92 |
| 21 | 32 | 70 | 22.3 | 1300 | 93 |

EXAMPLES 22 AND 23 AND COMPARATIVE EXAMPLE 6

The same procedures as those for producing the first impregnated, heat-treated polyester filament yarn described in Example 1 were carried out.

A second impregnating liquid was prepared by diluting the same water-soluble polyurethane compound as that described in Example 1 with water to an extent that the concentration of the water-soluble polyurethane compound in the diluted solution became 10% by dry weight.

A third impregnating liquid was prepared in the same manner as that used for the preparation of the second impregnating liquid described in Example 9.

The first impregnated, heat-treated polyester filament yarn was converted into a cord by first twisting the yarn at a first twisting number of 15 turns/10 cm and by finally twisting three of the first twisted yarns together at a final twisting number of 9 turns/10 cm.

The cord was impregnated with the second treating liquid by using the same tire cord treating machine as that described in Example 1, and the second impregnated cord was dried at a temperature of 100° C. for 120 seconds and, then, heat-treated at a temperature of 240° C. for 160 seconds.

The second heat-treated cord had a 2.5% by dry weight of the second impregnating material based on the weight of the cord.

The second heat-treated cord was third impregnated with the third impregnating liquid so that 2.4% by dry weight of the third impregnated material based on the weight of the cord was picked up by the cord.

The third impregnated cord was dried at a temperature of 100° C. for 120 seconds and, then, third heat-treated at a temperature of 240° C. for 60 seconds.

The resultant cord was subjected to the tests of the T-bonding strength, resistance to peeling, resistance to bending and resistance to separation of the yarns from each other.

In the tests of the T-bonding strength, the rubber block was made from a mixture of 70 parts by weight of natural rubber and 30 parts by weight of styrene-butadiene rubber and vulcanized at a temperature of 160° C. for 20 minutes.

The resistance of the cord to separation of the yarns from each other was determined by rubbing a side surface of a specimen 1000 times with an abrasive paper having a coarseness of AA-60 and by observing how the yarns in the rubbed side surface of the specimen separated from each other.

The results of the tests are indicated in Table 6.

In Comparative Example 6, the same procedures as those mentioned in Example 22 were carried out, except that the oiling liquid contained no ethylene-glycol diglycidyl ether and no laurylamine-ethylene oxide addition product.

In Example 23, the same procedures as those mentioned in Example 22 were carried out, except that, the oiling liquid contained no ethylene glycol diglycidyl ether, and after the resultant oiled polyester filament yarn was converted to the cord in the same manner as that described in Example 21, the cord was first impregnated with a first impregnating liquid containing ethylene glycol diglycidyl ether, and dried at a temperature of 120° C. for 120 seconds and first heat-treated at a temperature of 240° C. for 60 seconds.

The results of the tests applied to the products of Example 23 and Comparative Example 6 are indicated in Table 6.

TABLE 6

| Example No. | | T-bonding strength (kg/cm) | Resistance to peeling (kg/3 c) | Resistance to bending (g) | Resistance to separation of yarns from each other |
|---|---|---|---|---|---|
| Example | 22 | 31 | 22 | 71 | Excellent |
| Comparative Example | 6 | 21 | 13 | 25 | Poor |

TABLE 6-continued

| Example No. | | T-bonding strength (kg/cm) | Resistance to peeling (kg/3 c) | Resistance to bending (g) | Resistance to separation of yarns from each other |
|---|---|---|---|---|---|
| Example | 23 | 32 | 25 | 43 | Good |

EXAMPLE 24 AND 25

In Example 24, the same procedures as those described in Example 22 were carried out except that the same water-soluble polyurethane compound as that described in Example 4 was used.

In Example 25, the same procedures as those described in Example 22 were carried out except that the same water-soluble polyurethane compound as that described in Example 3 was used.

The results of the tests are indicated in Table 7.

TABLE 7

| Example No. | T-bonding strength (kg/cm) | Resistance to peeling (kg/3 c) | Resistance to bending (g) | Resistance to separation of yarns from each other |
|---|---|---|---|---|
| 24 | 31 | 23 | 73 | Excellent |
| 25 | 32 | 24 | 72 | " |

EXAMPLES 26 TO 30

In each of the Examples 26 to 30, the same procedures as those described in Example 22 were carried out, except that the third impregnating liquid contained 20 g of an aqueous dispersion or solution containing 20% by weight of an addition component consisting a compound as described below, per 180 g of the RFL liquid.

Example 26: Blocking reaction product of 4,4'-diphenylmethane diisocyanate with ε-caprolactam Example 27: Blocking reaction product of 4,4'-diphenylmethane diisocyanate with phenol Example 28: Diphenylmethane diethyleneurea Example 29: Triphenylmethane triethyleneurea Example 30: The same water-soluble polyurethane compound as that mentioned in Example 22.

The results of the tests are shown in Table 8.

TABLE 8

| Example No. | T-bonding strength (kg/cm) | Resistance to peeling (kg/3 c) | Resistance to bending (g) | Resistance to separation of yarns from each other |
|---|---|---|---|---|
| 26 | 33 | 23 | 71 | Excellent |
| 27 | 32 | 25 | 72 | " |
| 28 | 33 | 23 | 72 | " |
| 29 | 34 | 26 | 75 | " |
| 30 | 33 | 25 | 74 | " |

EXAMPLES 31 TO 34

In each of the Examples 31 to 34, the same procedures as those described in Example 22 were carried out, except that the second impregnating liquid contained 20 g of an aqueous dispersion containing 10% by weight of a polyepoxide compound as described below and 10%, based on the dry weight of the polyepoxide component, of an emulsifying agent consisting of sodium dioctylsulfosuccinate, per 180 g of the aqueous solution of 10% by weight of the water-soluble polyurethane compound.

Example 31: Glycerine diglycidyl ether

Example 32: Diglycerine diglycidyl ether

Example 33: Sorbitol polyglycidyl ether

Example 34: Ethyleneglycol diglycidyl ether

The results of the tests are shown in Table 9.

TABLE 9

| Example No. | T-bonding strength (kg/cm) | Resistance to peeling (kg/3 c) | Resistance to bending (g) | Resistance to separation of yarns from each other |
|---|---|---|---|---|
| 31 | 31 | 23 | 72 | Excellent |
| 32 | 32 | 23 | 72 | " |
| 33 | 33 | 25 | 74 | " |
| 34 | 31 | 22 | 70 | " |

I claim:

1. A polyester fiber composite material useful for reinforcing rubber articles, comprising a substrate of a polyester fiber material impregnated with a polymeric impregnating material which comprises at least the four components of: (A) at least one polyepoxide composition, (B) at least one rubber latex, (C) at least one prepolymer of resorcin with formaldehyde and (D) from 0.1 to 10% of at least one water-soluble polyurethane compound based on the weight of the substrate, each of said components being heat-treated on said substrate at least once at a temperature of between 120° C. and the melting point of said polyester fiber material, said water-soluble polyurethane compound having the formula (I):

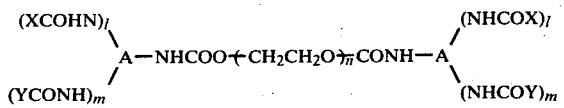

wherein A represents a tri- or hepta-valent radical, X represents a monovalent residue of a blocking compound having an activated hydrogen atom which residue is capable of dissociating from the polyurethane compound when said heat-treatment is applied thereto; Y represents a monovalent residue of an anionic radical-containing compound selected from the group consisting of aminosulfonic acids having 2 to 6 carbon atoms and aminocarboxylic acids having 1 to 6 carbon atoms; n represents an integer of 5 to 30, and; l and m represent an integer of 1 to 5, respectively, the sum of l and m is an integer of 2 to 6.

2. A polyester fiber composite material as claimed in claim 1, wherein said substrate is first impregnated with a first impregnating material comprising said polyepoxide compound, said impregnated polymeric material being first heat-treated on said substrate at a temperature of from 150° to 260° C., to form a once impregnated substrate said once impregnated substrate is impregnated with a second impregnating material comprising said water-soluble polyurethane compound of the formula (I), said resorcin-formaldehyde prepolymer and said rubber latex, said once impregnated substrate impregnated with the second impregnating material having been heat-treated at a temperature of 150° to 260° C.

3. A polyester fiber composite material of claim 1, wherein said substrate is impregnated with a first impregnating material comprising said polyepoxide compound, said water-soluble polyurethane compound of the formula (I) and said rubber latex, said first impregnating material being heat-treated on said substrate at a temperature of between 180° C. and the melting temperature of said polyester fiber material to form a once impregnated substrate; and said once impregnated substrate is impregnated with a second impregnating composition comprising said resorcin-formaldehyde prepolymer and said rubber latex, said once impregnated substrate impregnated with a second impregnating composition having been heat-treated at a temperature of between 120° C. and the melting point of said polyester fiber material.

4. A polyester fiber composite material of claim 1, wherein said substrate is first impregnated with a first impregnating material comprising said polyepoxide compound, said first impregnating material having been heat-treated on said substrate at a temperature of 150° to 260° C. to form a first impregnated product; said first impregnated product is then impregnated with a second impregnating material comprising said water-soluble polyurethane compound of the formula (I), said first impregnated product impregnated with said second impregnating material having been heated treated at a temperature of between 180° C. and the melting point of said polyester fiber material to form a twice impregnated product, and; said twice impregnated product is impregnated with a third impregnating material comprising said resorcin-formaldehyde prepolymer and said rubber latex, said twice impregnated product impregnated with said third impregnating material having been heat treated at a temperature of between 120° C. and the melting point of said polyester fiber material.

5. A polyester fiber composite material as claimed in claim 1, 2, 3 or 4, wherein the entire dry weight of said polymeric impregnating material is in the range of from 2 to 20% based on the weight of said substrate.

6. A polyester fiber composite material as claimed in claim 1, 2, 3 or 4, wherein the dry weight of said polyepoxide compound is in the range of from 0.05 to 2.0% based on the weight of said substrate.

7. A polyester fiber composite material as claimed in claim 1, 2, 3 or 4, wherein the dry weight of said rubber latex is in the range of from 0.1 to 10% based on the weight of said substrate.

8. A polyester fiber composite material as claimed in claim 1, 2, 3 or 4, wherein the dry weight of said resorcin-formaldehyde prepolymer is in the range of from 0.01 to 5% based on the weight of said substrate.

9. A polyester fiber composite material as claimed in claim 1, wherein said polymeric impregnating material contains an additional component consisting of at least one member selected from the group consisting of ethylene urea compounds of the formula (II):

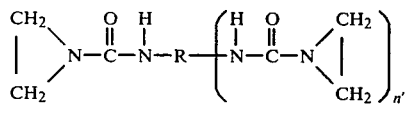

(II)

wherein R stands for an aromatic or aliphatic hydrocarbon residue and n' is 0, 1 or 2, and blocked polyisocyanate compounds of the formula (IV):

$$A'(NHCOX')r \qquad (IV)$$

wherein X' represents a residue of a blocking compound which residue is capable of dissociating from the blocked polyisocyanate compound when heat-treated, r represent an integer of 2 or more and A; represents an r valent radical.

10. A polyester fiber composite material as claimed in claim 1, wherein said tri- to hepta-valent radical A is a residue of an organic polyisocyanate compound having 3 to 7 isocyanate radicals.

11. A polyester fiber composite material as claimed in claim 10, wherein said organic polyisocyanate compound is selected from the group consisting of triphenylmethane triisocyanate, polymethylenepolyphenylisocyanate having 3 to 7 isocyanate groups, addition products of lower polyols having 3 to 7 hydroxyl groups with diisocyanate compounds and trimer of hexamethylene diisocyanate.

12. A polyester fiber composite material as claimed in claim 1, wherein said blocking compound is selected from the group consisting of phenol compounds, aliphatic tertiary alcohol compounds, aromatic secondary amine compounds, aromatic imide compounds lactam compounds, oxime compounds and sodium hydrogen sulfite.

13. A polyester fiber composite material as claimed in claim 12, wherein said phenol compounds are selected from the group consisting of phenol thiophenol, alkylphenols in which the alkyl group has 1 to 9 carbon atoms and resorcin.

14. A polyester fiber composite material as claimed in claim 1, wherein said anionic radical-containing compound is selected from the group consisting of taurine, N-methyl taurine, N-butyl taurine, glycine and alanine.

15. A polyester fiber composite material as claimed in claim 1, wherein said polyepoxide compound (A) contains at least two epoxy groups per molecule thereof.

16. A polyester fiber composite material as claimed in claim 1, wherein said polyepoxide compound (A) is selected from the group consisting of reaction products of polyhydric alcohols with halogenated epoxide compounds, reaction products of polyhydric phenol compounds with halogenated epoxide compounds and oxidation products of unsaturated organic compounds having at least one aliphatic double bond with peracetic acid or hydrogen peroxide.

17. A polyester fiber composite material as claimed in claim 1, wherein said polyepoxide compound (A) is selected from polyglycidyl ethers of polyhydric alcohols, which are reaction products of epichlorohydrin with polyhydric alcohols.

18. A polyester fiber composite material as claimed in claim 16 or 17, wherein said polyhydric alcohol is selected from the group consisting of ethylene glycol, glycerol, diglycerol, diethylene glycol, sorbitol, pentaerythritol trimethylol propane, polyethylene glycols and polypropylene glycols.

19. A polyester fiber composite material as claimed in claim 16, wherein said halogenated epoxide compound is epichlorohydrin.

20. A polyester fiber composite material as claimed in claim 16, wherein said polyhydric phenol compound is selected from the group consisting of resorcin, catechol, 2,2-bis(4-hydroxyphenyl)propane, bis(4-hydroxyphenyl) dimethylmethane, phenol-formaldehyde resins and resorcin-formaldehyde resins.

21. A polyester fiber composite material as claimed in claim 16, wherein said oxidation product is selected from the group consisting of 4-vinyl cyclohexene dioxide, 3,4-epoxycyclohexylmethyl-3,4-epoxycyclohexene carboxylate and bis(3,4-epoxy-6-methylcyclohexylmethyl)adipate.

22. A polyester fiber composite material as claimed in claim 1, wherein said rubber latex (B) is selected from the group consisting of natural rubber latexes and synthetic rubber latexes.

23. A polyester fiber composite material as claimed in claim 22, wherein said synthetic rubber latex (B) is selected from the group consisting of styrene-butadiene copolymer latexes, butadiene-vinyl pyridine copolymer latexes, vinyl pyridine-styrene-butadiene terpolymer latexes, acrylonitrile rubber latexes acrylonitril-butadiene copolymer latexes and chloroprene rubber latexes.

24. A polyester fiber composite material as claimed in claim 1, wherein the molar ratio of said resorcin to said formaldehyde is in a range of from 1:0.1 to 1:8.

25. A polyester fiber composite material as claimed in claim 9, wherein said ethylene urea compound of the formula (II) is a reaction product of ethyleneimine with an isocyanate selected from the group consisting of octadecylisocyanate, hexamethylenediisocyanate, isophoronediisocyanate, tolylenediisocyanate, methaxylene diiisocyanate, diphenylmethanediisocyanate, naphthylenediisocyanate, and triphenylmethanetriisocyanate.

26. A process for producing a polyester fiber composite material useful for reinforcing rubber articles comprising impregnating at least once a substrate comprising a polyester fiber material with polymeric impregnating materials which comprises at least the four components:

(A) at least one polyepoxide compound;

(B) at least one rubber latex;

(C) at least one prepolymer of resorcin with formaldehyde, and:

(D) from 0.1 to 10% of at least one water-soluble polyurethane compound based on the weight of the substrate, alone or in combination and drying said impregnated substrate and heat treating said dried impregnated substrate after each impregnation at a temperature of between 120° C. and the melting point of the polyester fiber material, (1) by impregnating said substrate at least once, in each impregnating procedure, with an impregnating liquid containing at least one of said components, and (2) by applying, after each impregnating procedure, a drying procedure and a heat-treatment to said impregnated substrate at a temperature of between 120° C. and the melting point of said polyester fiber material, wherein said water soluble polyurethane compound having the formula (I):

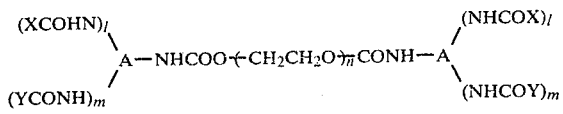

wherein A represents a tri- to hepta-valent radical; X represents a monovalent residue of a blocking compound having an activated hydrogen atom which residue is capable of dissociating from the polyurethane compound when said heat-treatment is applied thereto; Y represents a monovalent residue of an anionic group-forming compound selected from the group consisting of aminosulfonic acids having 2 to 6 carbon atoms and aminocarboxylic acids having 1 to 6 carbon atoms; n represents an integer of 5 to 30, and; l and m represent an integer of 1 to 5, respectively, and the sum of l and m is an integer of 2 to 6.

27. A process as claimed in claim 26, wherein said polyepoxide compound is heat-treated in the presence of an epoxy hardening agent consisting of at least one higher fatty acid-tert-amine compound of the formula (III):

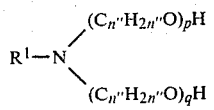

(III)

wherein $R^1$ represents a member selected from the group consisting of unsaturated and saturated alkyls having 8 to 22 carbon atoms, n'' represents an integer of 2 or 3 and p and q represent an integer of 1 to 30, respectively.

28. A process as claimed in claim 26, wherein the amount of said epoxy-hardening agent is in the range of 5 to 30% based on the weight of said polyepoxide compound used.

29. A process of claim 26, wherein said substrate is first impregnated with a first impregnating liquid comprising said polyepoxide compound dried and heat-treated at a temperature of 150° to 260° C. to form a once impregnated product; impregnating the once impregnated product with a second impregnating liquid containing said water-soluble polyurethane compound of the formula (I), said resorcin-formaldehyde prepolymer and said rubber latex to form a twice impregnated product, and; drying the twice impregnated product and heat-treating the twice dried impregnated product at a temperature of 150° to 260° C.

30. A process as claimed in claim 29, wherein said once impregnated product is aged at a temperature of 40° to 100° C. for 8 hours or more, before said second impregnating procedure.

31. A process as claimed in claim 29, wherein the amount of said water-soluble polyurethane compound is in the range of 0.5 to 40% based on the weight of the sum of said resorcin-formaldehyde reaction product and said rubber latex.

32. A process as claimed in claim 29, wherein in said second impregnating liquid, the ratio in weight of said resorcin-formaldehyde reaction product to said rubber latex is in the range of 1:1 to 1:15.

33. A process of claim 26, wherein said substrate is first impregnated with a first impregnating liquid containing said polyepoxide compound, said water-soluble polyurethane compound of the formula (I) and said rubber latex; dried; and heat-treated at a temperature of between 180° C. and the melting temperature of said polyester fiber material to form a once impregnated product; impregnating the once impregnated product with a second impregnating liquid containing said resorcin-formaldehyde prepolymer and said rubber latex to form a twice impregnated product, and; drying the twice impregnated product and heat-treating the dried twice impregnated product at a temperature of between 120° C. and the melting point of said polyester fiber material.

34. A process as claimed in claim 33, wherein in said first impregnating liquid, the ratio in weight of said polyepoxide compound to the sum of said polyepoxide compound and said water-soluble polyurethane compound of the formula (I) is in the range of from 0.05:1 to 0.9:1.

35. A process as claimed in claim 33, wherein in said first impregnating liquid, the ratio in weight of said rubber latex to the sum of the polyepoxide compound and said water-soluble polyurethane compound of the formula (I) is in the range of from 0.5:1 to 15:1.

36. A process as claimed in claim 33, wherein in said second impregnating liquid, the ratio in weight of said resorcin-formaldehyde prepolymer to said rubber latex is in the range of from 1:1 to 1:15.

37. A process as claimed in claim 33, wherein said second impregnating liquid contains an additional component consisting of at least one member selected from the group consisting of ethylene urea compounds of the formula (II):

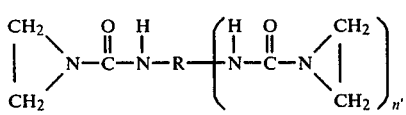

(II)

wherein R stands for an aromatic or aliphatic hydrocarbon residue and n' is 0.1 or 2; blocked polyisocyanate compounds of the formula (IV):

$$A'(NHCOX')r \qquad (IV)$$

wherein X' represents a residue of a blocking compound which residue is capable of dissociating from said blocked polyisocyanate compound when heat-treated, r represents an integer of 2 or more and A' represents a r valent radical, and; said water-soluble polyurethane compounds of the formula (I).

38. A process as claimed in claim 37, wherein said additional component is in the amount of 0.5 to 30% based on the sum of the weights of said resorcin-formaldehyde prepolymer and said rubber latex.

39. A process of claim 26, wherein said substrate is first impregnated with a first impregnating liquid containing said polyepoxide compound; dried, and heat-treated at a temperature of 150° to 260° C. to form a first impregnated product; impregnating the first impregnated product with a second impregnating liquid containing said water-soluble polyurethane compound of the formula (I) to form a twice impregnated product; drying the twice impergnated product and heat-treating the dried twice impregnated product at a temperature between 180° C. and the melting point of said polyester fiber material to form a heat-treated twice impregnated product; impregnating the heat-treated twice impregnated product with a third impregnating liquid containing said resorcin-formaldehyde prepolymer and said rubber latex to form a thrice impregnated product; drying the thrice impregnated product and; heat-treating the dried thrice impregnated product at a temperature of between 120° C. and the melting point of said polyester fiber material.

40. A process as claimed in claim 39, wherein said second impregnating liquid contains a polyepoxide compound in a concentration of 0.5 to 30% by weight.

41. A process as claimed in claim 39, wherein in said third impregnating liquid, the ratio in weight of said resorcin-formaldehyde prepolymer to said rubber latex is in the range of from 1:1 to 1:15.

42. A process as claimed in claim 39, wherein said third impregnating liquid contains an additional component consisting of at least one member selected from the group consisting of ethylene urea compounds of the formula (II):

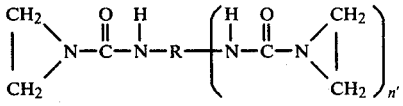

(II)

wherein R stands for an aromatic or aliphatic hydrocarbon residue and n' is 0.1 or 2; blocked polyisocyanate compounds of the formula (IV):

$$A'(NHCOX')r \qquad (IV)$$

wherein X' represents a residue of a blocking agent which residue is capable of dissociating from said blocked polyisocyanate compound when heat-treated, r represents an integer of 2 or more and A' represents an r valent radical, and; said water-soluble polyurethane compounds of the formula (I).

43. A process as claimed in claim 42, wherein said additional component in said third impregnating liquid is in an amount of 0.5 to 3% based on the dry weight of the sum of said resorcin-formaldehyde prepolymer and said rubber latex.

* * * * *